US008267088B2

(12) United States Patent
Steindorf et al.

(10) Patent No.: US 8,267,088 B2
(45) Date of Patent: Sep. 18, 2012

(54) COLLAPSE RESISTANT RESPIRATOR

(75) Inventors: Eric Steindorf, Roswell, GA (US); Debra Nell Welchel, Woodstock, GA (US); Craig Miles, Perrysburg, OH (US); Sara Stephan, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/362,877

(22) Filed: Jan. 31, 2012

(65) Prior Publication Data

US 2012/0125345 A1 May 24, 2012

Related U.S. Application Data

(63) Continuation of application No. 12/164,469, filed on Jun. 30, 2008, now Pat. No. 8,113,201.

(51) Int. Cl.
*A62B 7/10* (2006.01)
*A62B 23/02* (2006.01)
*A62B 18/08* (2006.01)

(52) U.S. Cl. ..... 128/206.13; 128/205.29; 128/206.16; 128/207.11

(58) Field of Classification Search ..... 128/205.27, 128/205.29, 206.12–206.21, 206.28, 207.11, 128/207.12; 2/9, 448, 450
See application file for complete search history.

(56) References Cited

U.S. PATENT DOCUMENTS 1,319,273 A 10/1919 Dobey
1,946,334 A 2/1934 Schwartz
2,378,971 A 6/1945 Biederman
2,556,589 A 6/1951 Le Duc
3,220,409 A 11/1965 Liloia et al.
3,333,585 A 8/1967 Barghini et al.
4,374,888 A 2/1983 Bornslaeger
4,384,577 A 5/1983 Huber et al.
4,414,973 A * 11/1983 Matheson et al. ..... 128/206.15
4,606,341 A 8/1986 Hubbard et al.
4,641,645 A 2/1987 Tayebi
4,850,347 A 7/1989 Skov
4,856,509 A 8/1989 Lemelson
4,907,584 A 3/1990 McGinnis
5,374,458 A 12/1994 Burgio
5,699,791 A 12/1997 Sukiennik et al.
5,701,893 A 12/1997 Kern et al.
5,727,544 A 3/1998 Miura
5,848,589 A 12/1998 Welnetz
5,863,312 A 1/1999 Wolfe
6,016,804 A 1/2000 Gleason et al.
6,047,698 A 4/2000 Magidson et al.
6,185,740 B1 2/2001 Zegarelli et al.

(Continued)

FOREIGN PATENT DOCUMENTS

GB 2103491 A 2/1983

(Continued)

*Primary Examiner* — Loan Thanh
*Assistant Examiner* — Kathryn D Sheikh
(74) *Attorney, Agent, or Firm* — Dority & Manning, P.A.

(57) ABSTRACT

A respirator including a collapse-resistant means for resisting collapse of the respirator main body due to respiration of a user during use of such a respirator is disclosed. Specifically, in various embodiments, the collapse-resisting means may be a deflection member, a stiffening material, fastening components configured to apply an outward-facing deflection force when the respirator is worn, or any combination thereof. Additionally, a dual exhalation vent assembly adapted for use in a collapse resisting respirator is also disclosed.

12 Claims, 9 Drawing Sheets

U.S. PATENT DOCUMENTS

| | | | |
|---|---|---|---|
| 6,474,336 | B1 | 11/2002 | Wolfe |
| 6,715,489 | B2 | 4/2004 | Bostock et al. |
| 6,923,182 | B2 | 8/2005 | Angadjivand et al. |
| 6,928,657 | B2 | 8/2005 | Bell et al. |
| 7,036,507 | B2 | 5/2006 | Jensen |
| 7,290,545 | B2 | 11/2007 | Kleman et al. |
| 2003/0154984 | A1 | 8/2003 | Fernandes |
| 2003/0205231 | A1 | 11/2003 | Shigematsu et al. |
| 2005/0098183 | A1 | 5/2005 | Nash et al. |
| 2005/0121029 | A1 | 6/2005 | Reisman |
| 2005/0133036 | A1 | 6/2005 | Steindorf |
| 2006/0130214 | A1 | 6/2006 | Steindorf |
| 2006/0130841 | A1 | 6/2006 | Spence et al. |
| 2007/0039620 | A1 | 2/2007 | Sustello |
| 2007/0251522 | A1 | 11/2007 | Welchel et al. |
| 2008/0026173 | A1 | 1/2008 | Angadjivand et al. |
| 2009/0000624 | A1* | 1/2009 | Lee et al. ..... 128/207.11 |
| 2009/0044811 | A1 | 2/2009 | Welchel et al. |
| 2009/0078261 | A1 | 3/2009 | Martin et al. |
| 2009/0078262 | A1 | 3/2009 | Gebrewold et al. |
| 2009/0078264 | A1 | 3/2009 | Martin et al. |
| 2009/0078265 | A1 | 3/2009 | Gebrewold et al. |
| 2009/0078266 | A1 | 3/2009 | Stepan et al. |
| 2009/0090364 | A1 | 4/2009 | Daugaard et al. |

FOREIGN PATENT DOCUMENTS

| | | | |
|---|---|---|---|
| JP | 08-155046 | A | 6/1996 |
| JP | 11-253566 | A | 9/1999 |
| JP | 2003-093528 | A | 4/2003 |

* cited by examiner

COLLAPSE RESISTANT RESPIRATOR

CROSS-REFERENCE TO RELATED APPLICATION

The present application is a Continuation Application of U.S. application Ser. No. 12/164,469, filed Jun. 30, 2008.

BACKGROUND

Respirators find utility in a variety of manufacturing, custodial, sporting, and household applications. In these types of applications, respirators filter out dust and other particulate aerosols to protect the respiratory system of the user from harmful or irritating contaminates. Likewise, respirators have found utility in the healthcare industry. In this regard, respirators are helpful in that they may be configured to filter exhaled air from the wearer to minimize the amount of bacteria or other contaminants released from the user into the environment. Such a limitation of bacteria contaminants is important in that hospital patients typically require a sterile environment in order to avoid infections, and hospital patients often have compromised immune systems making them susceptible to infection. Additionally, respirators may also filter inhaled air to protect the user from contaminants that may be found in a hospital setting, as hospital patients commonly carry airborne bacterial pathogens.

It is therefore the case that in the health care field, specifically in operating rooms, health care providers often use respirators to help protect themselves from acquiring harmful diseases such as AIDS and hepatitis along with other contagious diseases that may be present in the patients that are being treated.

Some respirators are configured to cover the entire face of a user while other respirators are designed to cover only the nose and mouth of the user. Additionally, respirators have been designed to cover various parts of a user's face. For instance, certain respirators are configured for covering the nose, eyes, and mouth of a user. The front panel section of the respirator that covers the nose and mouth typically is composed of a material that prevents the passage of germs and other contaminants there through but allows for the passage of air so that the user may breathe.

Respirators have also been designed to provide a tight seal to the user's face. Such sealing arrangements are important for the overall effectiveness of the respirator by preventing dust, particulates, airborne microbes or other contaminants from bypassing the filtering media of the respirator.

Attached to the respirator is a securing device that is used for attaching the front panel securely to the head of the user. For instance, rubber or elastic straps are commonly utilized in respirators used in industrial settings. Additionally, manual tie straps might be employed, especially for health-care respirators. The straps fasten the respirator to the user. For this purpose, the respirator is placed on the face of the user and the tie straps are extended around the head of the user.

Currently, disposable respirators, especially those used for industrial or related purposes, typically have a main body made of a thin molded structure of layers of materials configured to provide a tent-like shape covering the mouth and nose of the user. Alternatively, the materials used in the disposable respirator may be predominantly flat, but incorporate folds or pleats which can be expanded prior to use to provide a tent-like shape to cover the mouth and nose of the user. In order to protect the user, such respirators utilize a filter material through which all of the user's inhaled air is to pass through. As the user inhales, the user creates a negative pressure in the breathing chamber which may cause the body of the respirator to collapse against the mouth of the user. Such a collapse is uncomfortable to the user and may discourage regular use of such respirators.

Others have tried to address the issue of collapse through various solutions. Some respirators utilize thicker materials, stiffer materials, or add additional layers to help add rigidity to the respirator. See, for example, U.S. Pat. Nos. 4,850,347 and 6,715,489 and UK Patent Application 2103491. However, while more rigid materials help resist collapse, they also work against the need for wearer comfort and the need for the respirator to conform to the individualized shape of the user's face. Other solutions comprise various origami-type folds, pleats, and other alternate geometric configurations that provide a stronger architecture to the respirator. See, for example, U.S. Pat. Nos. 5,701,893; 6,474,336; 6,923,182; and 7,036,507. Such complex geometry requires specialized, and often more complicated, manufacturing processes and/or equipment. Additionally, such complex structures are often dependent on the user properly donning the respirator without disturbing the specific geometry of the respirator.

SUMMARY OF THE INVENTION

In light of the problems discussed above, a need still exists for a respirator that resists collapse from a user's respiration while the respirator is in use. Such a respirator would provide adequate comfort and requisite seal upon the face of the user. It is also desired that such a respirator would provide ease of manufacturing.

It has been found that disposable respirators may be constructed with particular elements, and configuration of such elements, to resist the collapse of the respirator as caused by a user's respiration during use of such a respirator. Specifically, the present disclosure is directed to a respirator having a main body, that covers the mouth and nose of a user, and a collapse-resisting means for resisting the collapse of the main body due to respiration by a user of such a respirator. For example, in various embodiments, the collapse-resisting means may be a deflection member, a stiffening material, fastening components configured to apply an outward-facing deflection force when the respirator is worn, or any combination thereof. Further, in some embodiments, such a respirator may be adapted to be substantially flat when a user is not wearing the respirator.

The present disclosure is also directed to a dual exhalation vent assembly adapted to attach to a respirator. The dual exhalation vent assembly includes an inner vent assembly with two inner vent bodies that are joined by a strut that extends between the inner vent bodies. The assembly additionally includes a pair of outer vent bodies that are adapted to join with the inner vent bodies such that portion of the main body of a respirator is disposed between the inner and outer vent bodies. In some embodiments, the pair of outer vent bodies are joined by a connector spanning between the outer vent bodies.

Finally, the present disclosure is also directed to a respirator having a main body, first and second fastening components on opposite sides of the main body, and a strap engaged with both fastening components. The first and second fastening components are configured to apply an outward-facing deflection force to the main body when the respirator is worn by a user.

Other objects and features will be in part apparent and in part pointed out hereinafter.

DEFINITIONS

Figure 1:
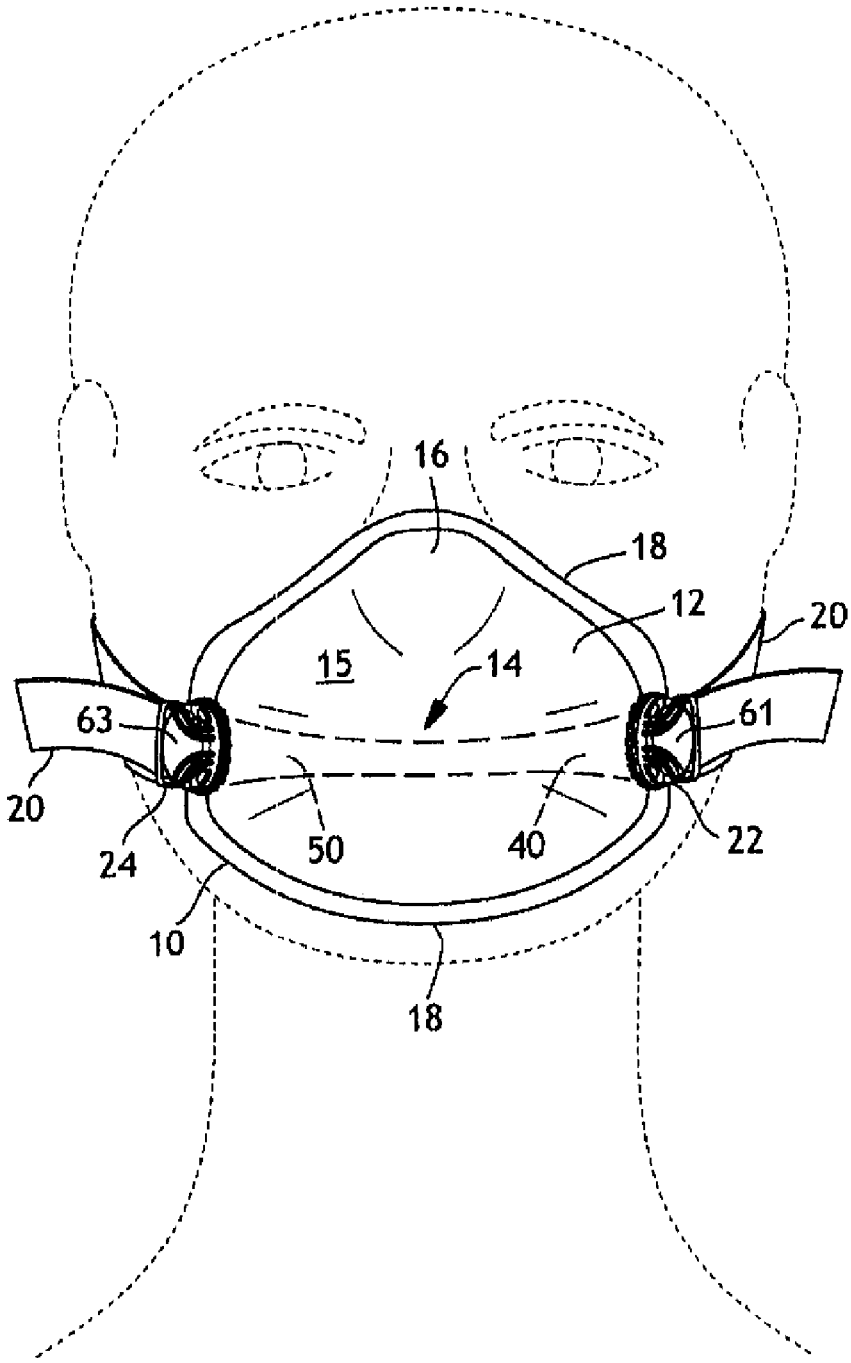
FIG. 1 is a front view of a respirator worn by a user according to the present disclosure.

Within the context of this specification, each term or phrase below includes the following meaning or meanings:

As used herein, the term "disposable" is not limited to single use articles but also refers to articles that are so relatively inexpensive to the consumer that they can be discarded if they become soiled or otherwise unusable after only one or a few uses. Such "disposable" articles are designed to be discarded after a limited use rather than being restored for reuse.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As used herein, the term "configure" or "configuration" means to design, arrange, set up, or shape with a view to specific applications or uses. For example: a military vehicle that was configured for rough terrain; configured the computer by setting the system's parameters.

As used herein, the terms "orientation" or "position" used interchangeably herein refer to the spatial property of a place where or way in which something is situated; for example, "the position of the hands on the clock."

The terms "disposed on," "disposed along," "disposed with," or "disposed toward" and variations thereof are intended to mean that one element can be integral with another element, or that one element can be a separate structure bonded to or placed with or placed near another element.

As used herein, the term "couple" or "affix" includes, but is not limited to, joining, connecting, fastening, linking, or associating two things integrally or interstitially together. As used herein, the term "releaseably affix(ed)" refers to two or more things that are stably coupled together and are at the same time capable of being manipulated to uncouple the things from each another.

"Attach" and its derivatives refer to the joining, adhering, connecting, bonding, sewing together, or the like, of two elements. Two elements will be considered to be attached together when they are integral with one another or attached directly to one another or indirectly to one another, such as when each is directly attached to intermediate elements. "Attach" and its derivatives include permanent, releasable, or refastenable attachment. In addition, the attachment can be completed either during the manufacturing process or by the end user.

"Connect" and its derivatives refer to the joining, adhering, bonding, attaching, sewing together, or the like, of two elements. Two elements will be considered to be connected together when they are connected directly to one another or indirectly to one another, such as when each is directly connected to intermediate elements. "Connect" and its derivatives include permanent, releasable, or refastenable connection. In addition, the connecting can be completed either during the manufacturing process or by the end user.

"Bond," "interbond," and their derivatives refer to the joining, adhering, connecting, attaching, sewing together, or the like, of two elements. Two elements will be considered to be bonded or interbonded together when they are bonded directly to one another or indirectly to one another, such as when each is directly bonded to intermediate elements. "Bond" and its derivatives include permanent, releasable, or refastenable bonding.

"Ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the content of which is incorporated herein by reference in its entirety.

"Layer" when used in the singular can have the dual meaning of a single element or a plurality of elements.

"Nonwoven" and "nonwoven web" refer to materials and webs of material that are formed without the aid of a textile weaving or knitting process. For example, nonwoven materials, fabrics or webs have been formed from many processes such as, for example, meltblowing processes, spunbonding processes, air laying processes, coform processes, and bonded carded web processes.

"Polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

These terms may be defined with additional language in the remaining portions of the specification.

DETAILED DESCRIPTION

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention include these and other modifications and variations.

The present invention is directed to a respirator having a main body and a collapse-resisting means for resisting the collapse of the main body while the respirator is worn by a user. The collapse-resisting means is intended to prevent the collapse of the inner layer(s) of the respirator against the face of the wearer when such a wearer is inhaling air through the filter material of the respirator. Such collapse-resisting means provides a respirator that is more comfortable to use while providing the fit and performance that is desired. It is not necessarily intended that such a collapse-resistant means prevent the respirator from collapsing upon application of an external impacting force. Additionally, in some embodiments, the respirator and the collapse-resisting means may be adapted such that the respirator may be configured to be substantially flat when not being worn by a user. Such a flat configuration allows the user to easily store the respirator (e.g., in a shirt or pants pocket) for future use.

Referring to FIGS. 1 to 8, typical respirators 10 will include a main body 12. The main body 12, is the portion of the respirator 10 adapted to filter, screen, or otherwise affect at least a portion of one or more constituents in air or gas being inhaled or exhaled through the respirator 10. Typically, the main body 12 may be in a variety of shapes and sizes, depending upon the desired end use of the respirator 10. Furthermore, the main body 12 of the respirator 10, or portions thereof, may be shaped or cut (including the cutting of openings in said main body that are adapted to receive at least a portion of, for example, a fastening component 22, 24) depending upon the desired end use of the respirator 10.

In some embodiments, the main body 12 of the respirator 10 is adapted to assume a planar configuration during shipment or storage, but may be opened-up, unfolded, or otherwise deployed at the time of use such that the main body 12 is adapted to fit over some portion of the face of a user. In an alternative embodiment, the main body 12 of the respirator 10 is adapted to assume a pre-formed or pre-molded cupped configuration and is immediately ready for use; that is, no alteration (i.e., unfolding or opening) of the main body 12 is needed to fit over some portion of the face of a user.

Generally, the main body 12 may comprise any suitable material known in the art. For example, the main body 12 of the respirator 10 of the present disclosure may comprise any nonwoven web materials, woven materials, knit materials, films, or combinations thereof. In a particularly preferred embodiment, the main body 12 comprises a nonwoven web material. Suitable nonwoven web materials include melt-blown webs, spunbonded webs, bonded carded webs, wet-laid webs, airlaid webs, coform webs, hydraulically entangled webs, and combinations thereof. In addition, nonwoven webs may contain synthetic fibers (e.g., polyethylenes, polypropylenes, polyvinyl chlorides, polyvinylidene chlorides, polystyrenes, polyesters, polyamides, polyimides, etc.).

The respirator 10 illustrated in FIG. 1 is shown as worn by a user. The main body 12 is of the type that covers the mouth and nose of the user. The main body 12 has an outer surface 15, facing away from the user during use, and an inner surface 13, facing the user during use. It is this inner surface 13 that the collapse-resistance means is to prevent from collapsing in the breathing chamber area (i.e., the area proximate the mouth and nostrils) of the respirator 10. The main body 12 defines a periphery 18 surrounding the respirator 10. Additionally, the main body 12 may be considered to have a peripheral portion 16, which is made up of the area of the main body 12 extending inward from the periphery 18 and includes all of the areas of the respirator that are configured to contact the face of the user (i.e., the bridge of the nose, the cheeks, the chin). A central portion 14 is present in the center of the main body 12 and is surrounded by the peripheral portion 16. The central portion 14 generally includes the breathing chamber of the respirator 10 and thus includes the portion of the respirator 10 most prone to collapse from a user's respiration during use.

Figure 2:
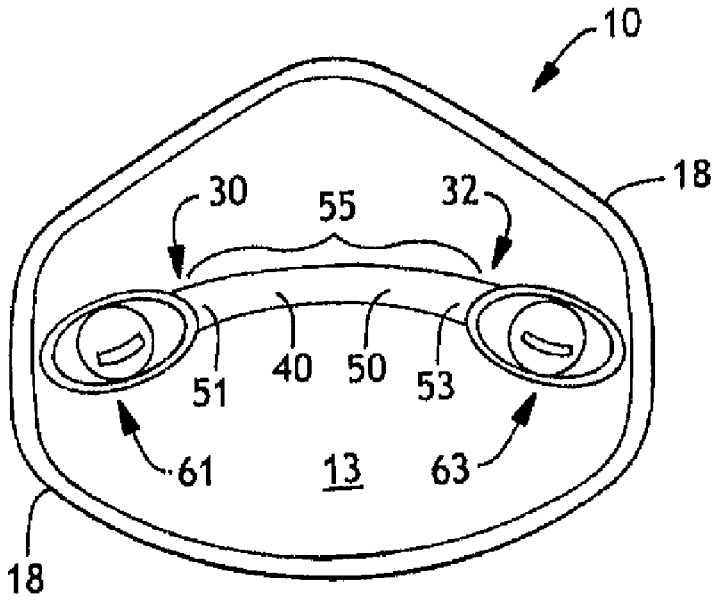
FIG. 2 is a rear view of the respirator shown in FIG. 1.

FIGS. 1 and 2 illustrate one embodiment of a respirator 10 with a collapse-resisting means. As illustrated in FIGS. 1 and 2, a deflection member 40 extends across the central portion 14 of the main body 12 from a first side (i.e., proximate the left side of the user's face) of the respirator 10 to an opposite second side (i.e., proximate the right side of the user's face). The deflection member 40 illustrated takes the form of a strut 50 that extends along the inside surface 13 of the respirator 10. The deflection member 40 spans between a first attachment point 30 on the inside surface 13 of the main body 12 and a second attachment point 32, also on the inside surface 13 opposite the first attachment point 30. In the particular embodiment illustrated in FIG. 2, the first attachment point 30 is associated with a first vent assembly 61 and the second attachment point 32 is associated with a second vent assembly 63.

To resist the collapse of the main body 12 during the user's respiration, the deflection member 40 will be generally bowed outward (away from the face of the user) during use of the respirator 10. In some embodiments, the deflection member 40 will have a shape that matches the general shape of the inside surfaces 13 of the respirator 10. In some embodiments, the deflection member 40 may be differently shaped than the inside surfaces 13 of the main body 13, but will preferably be shaped such that it will have minimal contact with the face of the user within the central portion 14 of main body 12.

Figure 9:
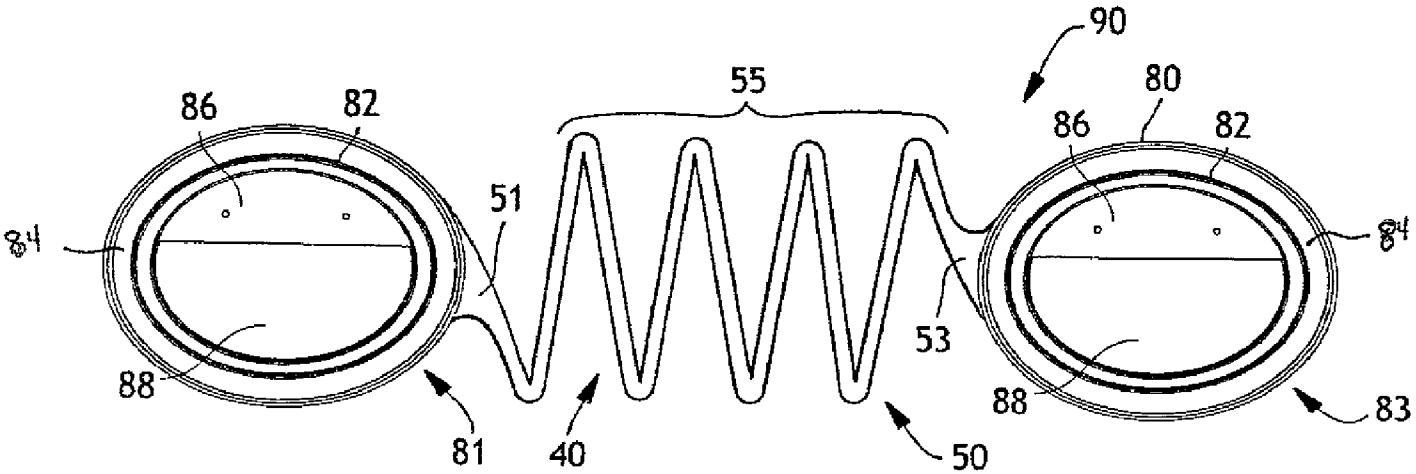
FIG. 9 is a view of an inner vent assembly of the present disclosure.

In addition to alternate shaped configuration relative to the shape of the inside surface 13 of the main body 12, the deflection member 40 may have alternate shapes and structures extending from an attachment point 30, 32. The deflection member 40 shown in FIGS. 1 and 2 is generally linear between the attachment points 30, 32. Alternatively, the deflection member 40 may have a wave shape such as illustrated in FIG. 9. Similarly, the deflection member 40 may include multiple lengths extending from an attachment point rather than the single straight strut 50, as shown in FIGS. 1 and 2. For example, the strut 50 may comprise a set of substantially parallel bars that extend between the first and second attachment points 30, 32. Additionally, or alternatively, the deflection member 40 may have a particular cross-sectional shape that further aids in resisting collapse. For example, the deflection member 40 have a concave, convex, hour-glass or other cross-sectional shape, relative to the wearer. It is contemplated that there are multitudes of shapes (symmetrical and asymmetrical), structures, cross-sections, and combinations thereof that may act as suitable deflection members 40 adequate to prevent the collapse of the main body 12 during use.

As shown in FIGS. 1 and 2, the strut 50 spans between the first and second attachment points 30, 32 and provides resistance to collapse of the main body 12 when the user inhales. Such a strut 50 may be solely attached to the main body 12 at the first and second attachment points 30, 32; the strut 50 freely spanning the length between the attachment points 30, 32. Alternatively, the strut 50 may be attached to the main body 12 at one or more points along the length of the deflection member 40. In some embodiments, the deflection member 40 may be attached to the main body 12 along the entirety of the deflection member 40.

Such a deflection member 40 will preferably be positioned along an inside surface 13 of the respirator 10, as shown in FIGS. 1 and 2. Such an orientation allows the deflection member 40 to resist the collapse of the main body 12 against the face of the user by its placement between the main body 12 and the user's face during use. It is contemplated that another embodiment may include a deflection member 40 placed along an exterior surface 15. However, such an exterior deflection member would require that the deflection member 40 be attached to main body 12 in multiple locations such that the deflection member 40 can prevent the main body 12 from collapse. A more preferable embodiment of an exterior deflection member would also include a corresponding deflection member 40 along an inside surface 13, where the internal and external deflection members 40 work cooperatively to resist the collapse of the main body.

Figure 12:
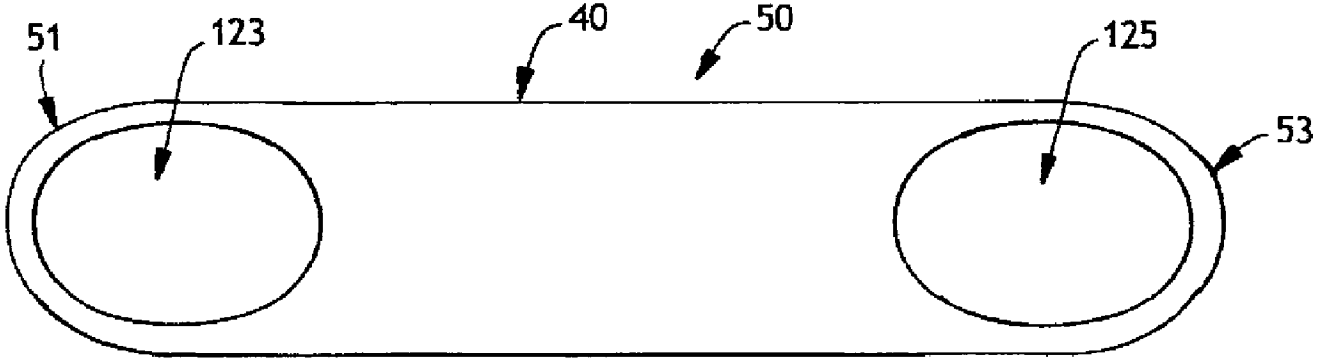
FIG. 12 is a view of an exemplary strut of the present disclosure.

The deflection member 40, such as illustrated in FIGS. 1 and 2, may be a separate, distinct element that is added to other elements of the respirator 10 or it may be an single member made up of a combination of elements. The deflection member 40 illustrated in FIGS. 1 and 2 may be a simple strut 50 such as illustrated in FIG. 12, which is attached to the first and second exhalation vent assemblies 61, 63. Such a strut 50 may include a first end 51 having a first opening 123 though which the inner vent body 80 and the outer vent body 93 of the first exhalation vent assembly 61 may cooperatively join the strut 50 with the main body 13 at the first attachment point 30. Similarly, a second end 53 of the strut 50 may have a second opening 125 to similarly cooperatively join with the main body 12 with the aid of a second exhalation valve assembly 63.

Figure 10:
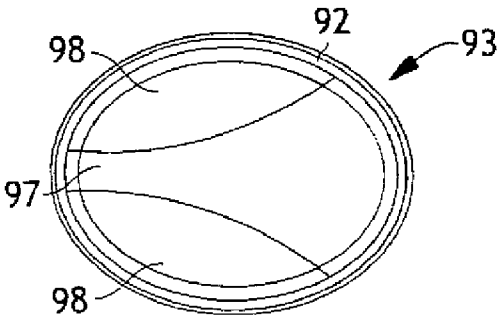
FIG. 10 is a view of an outer vent body of the present disclosure.

Alternatively, the deflection member 40 illustrated in FIGS. 1 and 2 may be part of an exhalation vent assembly, such as shown in FIG. 9. As illustrated in FIG. 9, the strut 50 may have a first end 51 that is attached to a first inner vent body 81 and a second end 53 that is attached to a second inner vent body 83. Together, the strut 50 and inner vent bodies 81, 83 form the inner vent assembly 90. The length 55 of the strut 50 extends between the first end 51 and the second end 53. Such inner vent bodies 81, 83 may be configured to engage individual outer vent bodies 93, such as illustrated in FIG. 10, to form the dual exhalation vent assembly.

Figure 11:
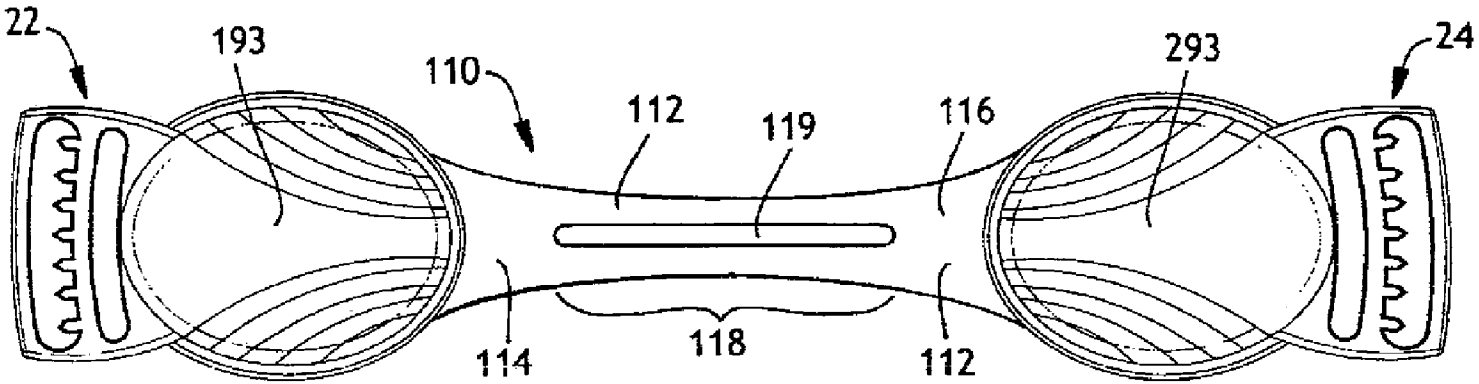
FIG. 11 is a view of an outer vent assembly of the present disclosure.

In some embodiments, the outer vent bodies may similarly be joined together into the unitary outer vent assembly 110 illustrated in FIG. 11. As shown in FIG. 11, a first outer vent body 193 is joined to a second outer vent body 293 by a connector 112 that extends between the first and second outer vent bodies 193, 293. The connector 112 has a first connector end 114 attached to the first outer vent body 193, a second connector end 116 attached to the second outer vent body 293, and a connector length 118 extending between the first and second connector ends 114, 116. The particular connector length 118 shown in FIG. 11 additionally includes a cutout 119.

Using a dual exhalation vent assembly including an inner vent assembly 90 (shown in FIG. 9) and an outer vent assembly 110 (shown in FIG. 11) would allow a simplification of the manufacturing process for the respirators 10 that would utilize such a dual exhalation vent assembly. Rather than accommodating two separate outer vent bodies and two separate inner vent bodies (four pieces in total), the use of the dual exhalation vent assembly would allow for a single inner vent assembly 90 to be attached to the unitary outer vent assembly 110, with the main body 12 of the respirator 10 disposed between the two pieces. The use of inner vent assembly 90 with two outer vent bodies 93 (such as in FIG. 10), similarly reduces the number of pieces used from four to three.

The deflection member 40 is shown in FIGS. 1 and 2 as attached to exhalation vents 61, 63, which additionally comprise first and second fastening components 22, 24. In alternate embodiments, the deflection member 40 may be attached to first and second attachment points 30, 32 associated with fastening components 22, 24 that do not include exhalation vents 60, such as fastening components illustrated in FIGS. 3 to 6. In other alternative embodiments, the first and second attachment points 30, 32 may not be associated with exhalation vents 60 or fastening components 22, 24. Instead the attachment points 30, 32 may be associated with the periphery 18 of the main body 12 or may simply be any desirably point on the main body 12.

Figure 3:
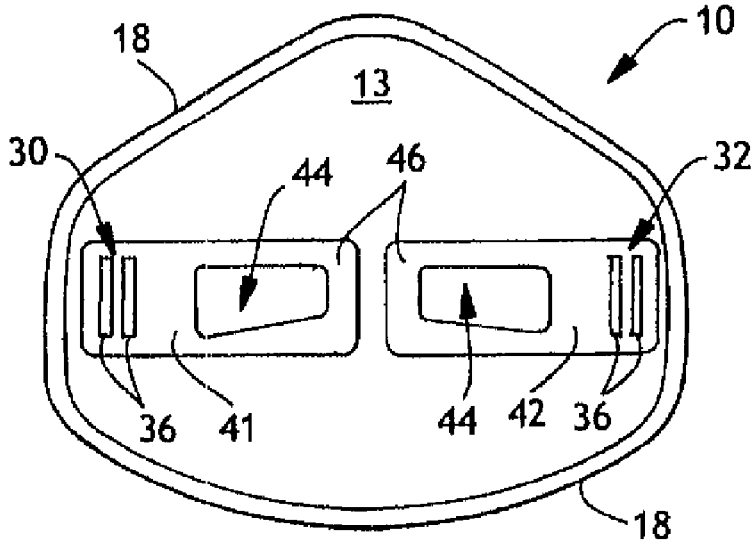
FIG. 3 is a rear view of a respirator according to the present disclosure.
Figure 4:
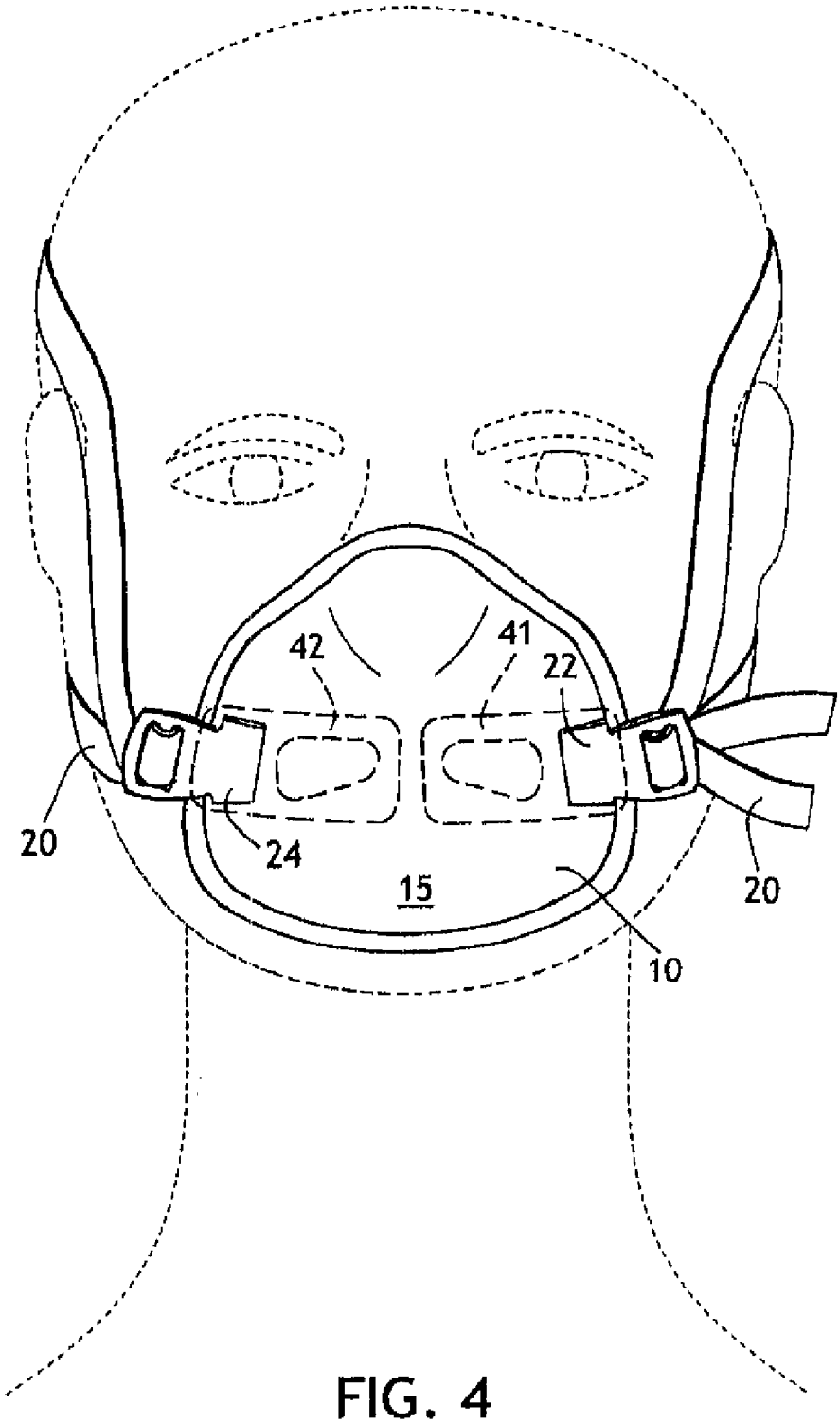
FIG. 4 is a front view of the respirator shown in FIG. 3 as worn by a user.

Another embodiment of the deflection member 40 collapse-resisting means is illustrated in FIGS. 3 and 4. As shown, the deflection member 40 may be comprised of a first deflection member 41 attached to the main body 12 at a first attachment point 30 on a first side of the main body 12 and a second deflection member 42 attached at a second attachment point 32 on an opposite second side of the main body 12. As shown in FIG. 4, the first deflection member 41 is operably connected to a first fastening component 22 and the second deflection member 43 is operable connected to a second fastening component 24. Such connection to the main body 12 may be made by any appropriate means, as are well known, to secure such elements. For example, ultrasonic welds 36 may be used to join the first and second deflection members 41, 42 to the first and second fastening components 22, 24.

As shown in FIGS. 3 and 4, the first and second deflection member 41, 42 extend from proximate the periphery 18 of the main body 12 and toward the central portion 14 of the main body 12. Such individual deflection members 41, 42 may be bonded solely at the first and second attachment points 30, 32 such that the deflection members 41, 42 are cantilevered. The deflection members 41, 42 shown in FIGS. 3 and 4 include cutouts 44 which may be included to reduce the amount of material used, may reduce weight and/or may improve the air flow through the main body 12 of the respirator 10. The deflection members 41, 42 may be any size or shape, symmetrical or asymmetrical, as desired such that they provide resistance to the collapse of the main body 12 during respiration of the user during use of the respirator 10.

The separate nature of the first and second deflection members 41, 43 may be used for respirators 10 where it is desired that the respirator 10 be able to be folded flat when not being used. In some embodiments, the first and second deflection members 41, 42 may be configured to interact with each other. As shown in FIGS. 3 and 4, the distal ends 46 of the deflection members 41, 42 extend toward each other, but do not touch in the central portion 14 of the respirator 10. In alternate embodiments, the deflection member 41, 42 may be longer such that the distal ends 46 overlap. In another alternate embodiment, the distal ends 46 may be adapted such that first deflection member 41 may be capable of joining to the second deflection member 42. For example, the first and second deflection members 41, 42 may include cooperative fasteners (such as matching slits, hook and loop fasteners, magnets, and the like) that releaseably engage each other to join the deflection members 41, 42 when the respirator 10 used, but may be disengaged when the respirator 10 is not being used.

In some embodiments of the present invention, the main body 12 of the respirator 10 is adapted to assume a planar configuration during shipment or storage, but which may be opened-up, unfolded, or otherwise deployed at the time of use such that the main body 12 is adapted to fit over some portion of the face of a user. For example, first and second deflection members 41, 42 as shown in FIGS. 3 and 4 may be configured such that they apply cantilevered resistance force to the main body 12 while the respirator 10 is being worn, will allow the respirator 10 to be folded in half (along a line perpendicular to the deflection members 41, 42 running between such members), when the respirator 10 is not being worn.

Alternately, in embodiments utilizing a strut 50, such as in FIGS. 1 and 2, the strut 50 may be configured to be similarly folded flat when the respirator 10 is not being used. To aid is such folding, the strut 50 may include one or more weakened segments along its length, it may include a cutout 44, or may be made of a material with some degree of rigidity to prevent collapse of the main body 12, but not so much that it can resist folding flat when the respirator 10 is not being worn by a user. Similarly, the strut 50 may be of a shape adapted to be provide collapse-resistance during use and the ability to fold substantially flat when not in use. For example, the wave-spring shape of the strut length 55 shown in FIG. 9 may allow such folding.

Figure 5:
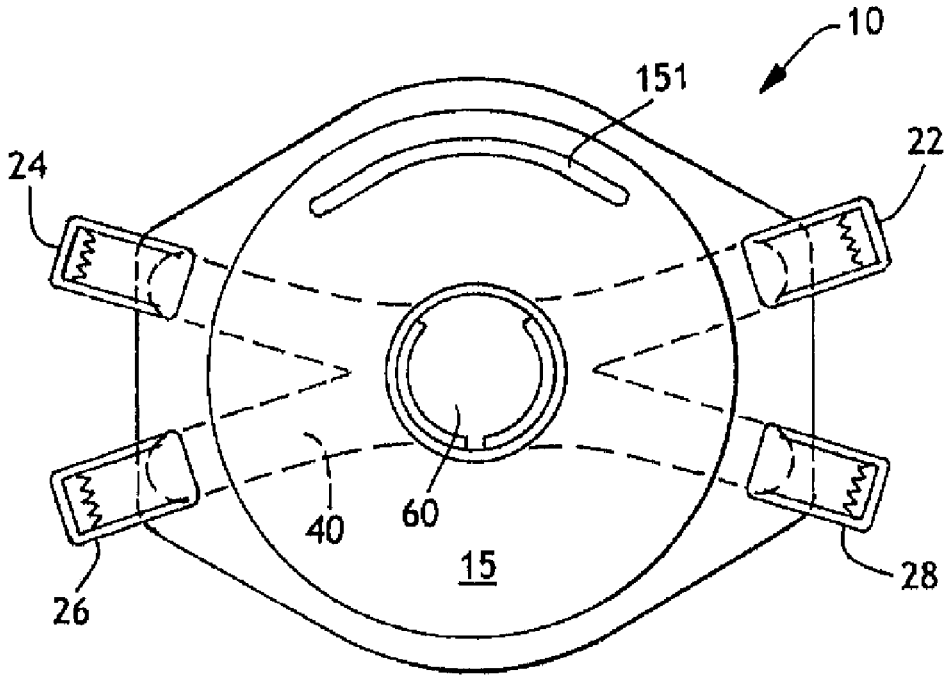
FIG. 5 is a front view of a respirator according to the present disclosure.
Figure 6:
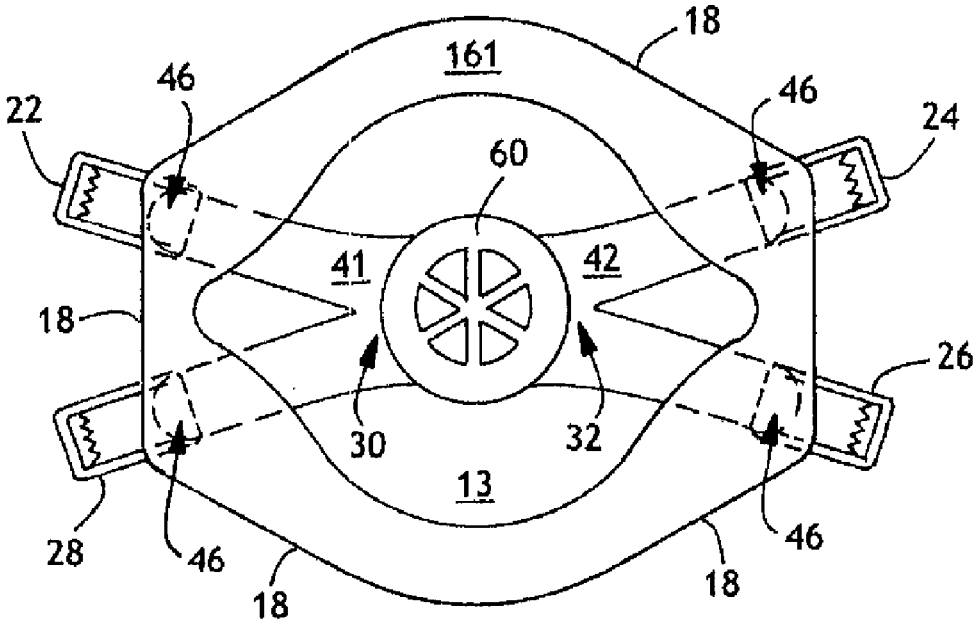
FIG. 6 is a rear view of the respirator of FIG. 5.

FIGS. 5 and 6 illustrate another possible embodiment utilizing multiple deflection members 40. A first and second deflection members 41, 42 are attached to first and second attachment points 30, 32 within the central portion 14 and extend toward the periphery 18 of the main body 12. The deflection members 41, 42 are associated with an exhalation vent 60 present in the central portion 14 of the respirator 10. The deflection members 41, 42 may be separate pieces each attached to the exhalation vent 60, may be a single piece attached to the exhalation vent 60, or may be a unitary member comprising the exhalation vent and each of the deflection members 41, 42.

In the embodiment illustrated in FIGS. 5 and 6, the first deflection member 41 extends from the first attachment point 30 toward the periphery 18 of the respirator 10, along the inside surface 13 of the main body 12. The first deflection member 41 splits into two extensions, one extending toward a first fastener component 22 and another extending toward a fourth fastener component 28. Similarly, the second deflection member 42, extends from the second attachment point 32 toward a second fastening component 24 and a third fastening component 26.

The first and second deflection members 41, 42 may be joined solely at the first and second attachment points 30, 32 such that the deflection members 41, 42 are cantilevered toward the periphery 18 of the respirator 10. In respirators 10 that include a gasket material 161 around periphery 18 on the inside of the main body 12 (such as shown in FIG. 6), the distal ends 46 of such cantilevered first and second deflection members 41, 42 may be held in place between the gasket material 161 and the inside surface 13. Alternatively, the distal ends 46 may be joined to respective fastening components 22, 24, 26, 28, to the inside surface 13, or some combination thereof.

Figure 13:
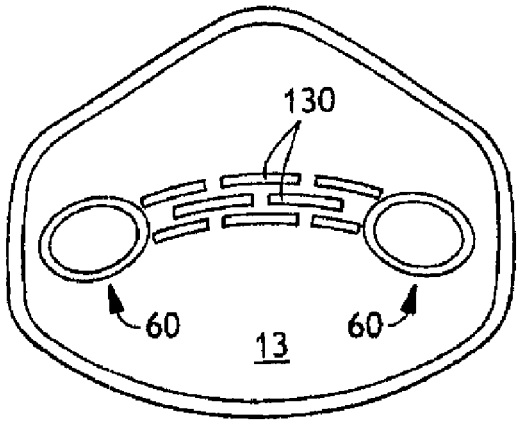
FIG. 13 is a rear view of a respirator according the present disclosure.
Figure 14:
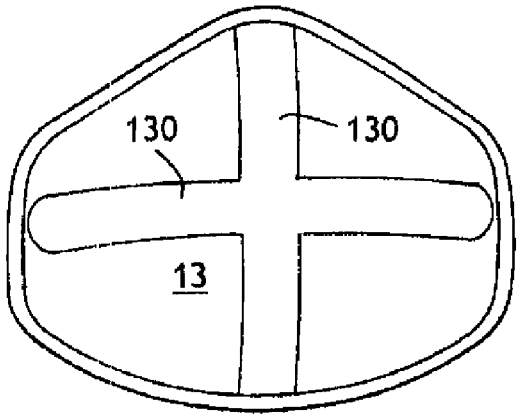
FIG. 14 is a rear view of a respirator according to the present disclosure.
Figure 15:
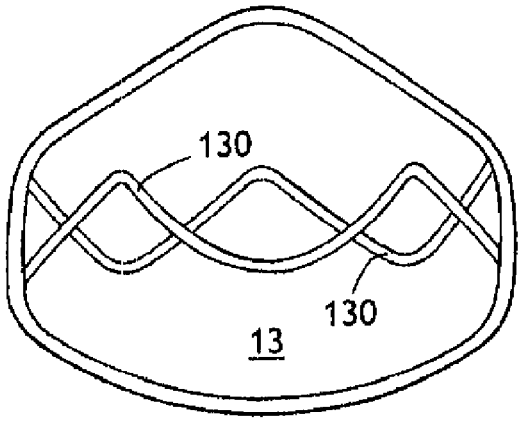
FIG. 15 is a rear view of a respirator according to the present disclosure.

FIGS. 13 to 15 illustrate another embodiment of respirators 10 with a deflection member 40 as the collapse-resisting means. In these embodiments, the deflection member 40 is provided in the form of a stiffening material that is positioned along the inside surface 13 of the main body 12. Such a stiffening material 130 may be an adhesive, such as a hot melt adhesive, epoxy, resin, or other polymer that may be applied along the inside surface 13 such that additional structure is added to portions of the central portion 14 to resist collapse of the main body 12 during respiration of the user during use of the respirator 10.

The stiffening material 130 may be applied to the inside surface in a single continuous line similar to the deflection members 40 illustrated in FIGS. 1-6. Alternately, other shapes and patterns may be utilized. FIG. 13 illustrates a discontinuous line pattern of stiffening material 130. FIG. 14 illustrates continuous lines of stiffening material 130 applied in a cross pattern. FIG. 15 illustrates continuous lines of stiffening material 130 applied in a overlapping wave pattern. Other patterns are also contemplated and one skilled in the art would understand how other alternate patterns of stiffening material 130 may be applied to the inside surface 13 of the main body 12 such that such stiffening material 130 would resist the collapse of the main body 12 during use of the respirator 10.

Figure 7:
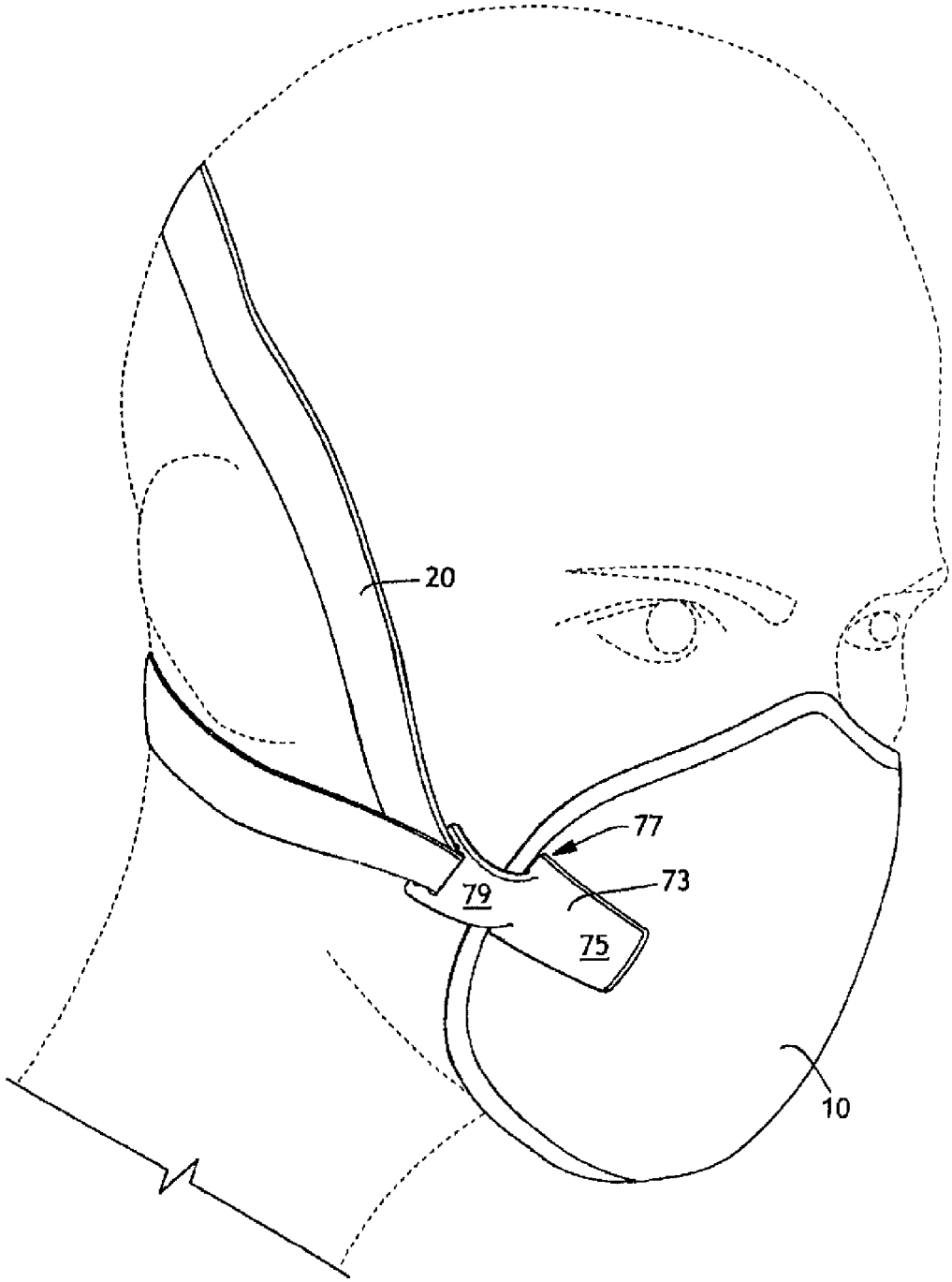
FIG. 7 is a right side view of a respirator worn by a user according to the present disclosure.
Figure 8:
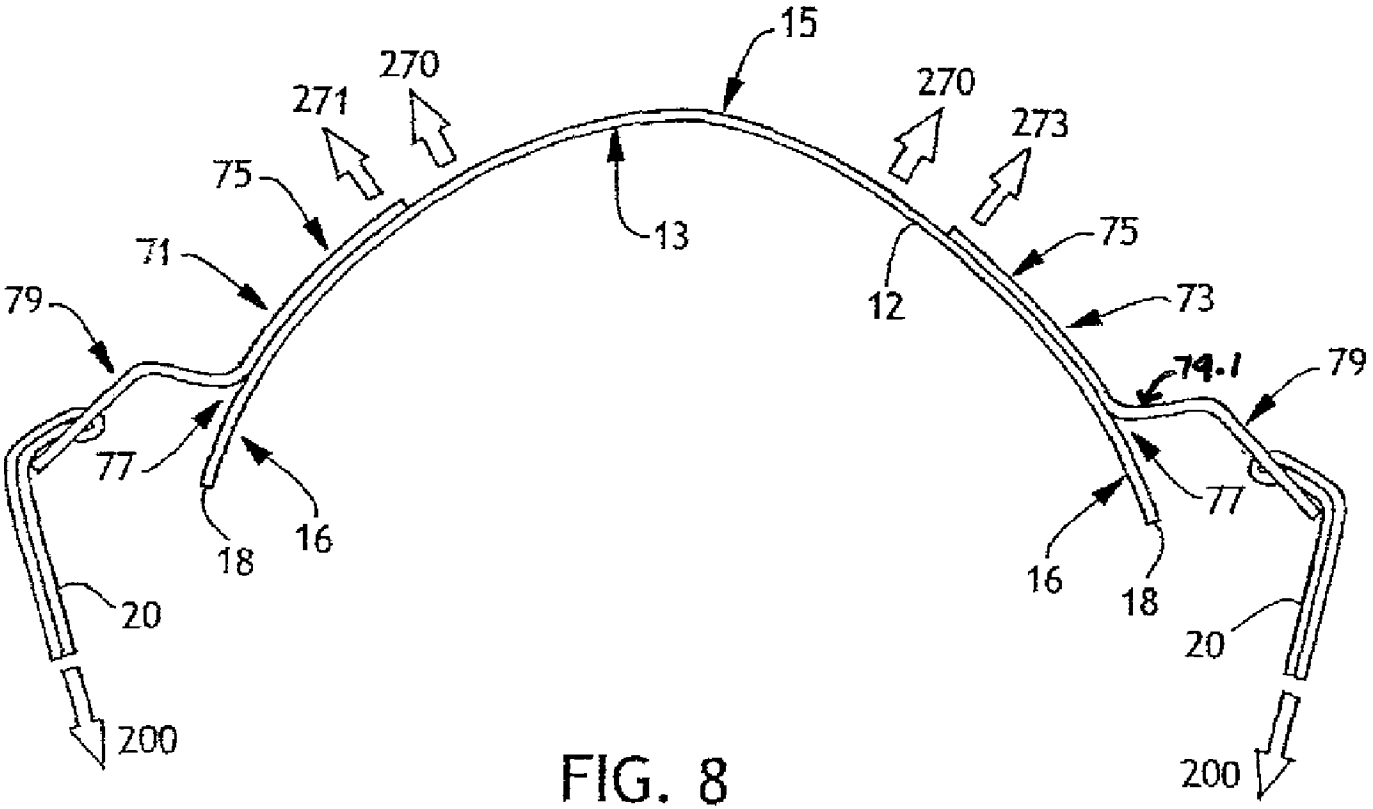
FIG. 8 is a top cross-sectional view of the respirator of FIG. 7.

FIGS. 7 and 8 illustrate another embodiment of the collapse-resisting means. The respirator 10 illustrated in FIGS. 7 and 8 includes fastening components 71, 73 that are configured to apply an outward-facing deflection force to the main body 12 when the respirator 10 is worn by the user. The particular fastening components 71, 73 may be designed such that when operably connected to both the main body 12 and a strap 20, the pull force exerted by the strap 20 on the fastening components 71, 73 is communicated to the main body 12. This outward-facing deflection force, shown by arrows 270 in FIG. 8, would bias the main body 12 of the respirator 10 away from the face of the user.

In the embodiment shown in FIGS. 7 and 8, the first fastening component 71 and the second fastening component 73 are attached to opposite sides of the respirator 10. The fastening component 71, 73 has a base portion 75 that is attached to the main body 12 and a fastener extension 79 that extends from the heel 77 of the base portion 75 and engages a strap 20. The fastener extension 79 includes an angled arm section 79.1 that extends outwardly and rearwardly from the heel 77. As shown in FIGS. 7 and 8, the particular configuration of the fastening component 71, 73 acts a lever with the heel 77 acting as a fulcrum. As shown in FIG. 8, when the respirator 10 is being worn, a pull force (as indicated by the arrow 200) is applied by the strap 20 engaged with the fastener extensions 79. The fastener components 71, 73 pivots on the heel 77 and outward deflection forces (as shown by arrows 271 and 273) are provided to the base 75. Such deflection forces in the base 75 are communicated to provide the same outward-facing deflection force 270 to the main body 12 of the respirator 10.

It should be noted that while each of the collapse-resisting means discussed above, and as illustrated in FIGS. 1-15, may be used separately, each of such means may also be used in various combinations. For example, the embodiment of the respirator 10 illustrated in FIGS. 1 and 2, utilizing a deflection member 40, may also include fastener components 71, 73 discussed in conjunction with the embodiment illustrated in FIGS. 7 and 8. In such a combination, the outward-facing deflection force 271, 273 applied by the fastener components 71, 73 may provide the strut 50 with additional resistance against collapse of the main body 12. Similarly, aspects of any of the embodiments may be used in combination with some or all of the aspects of other embodiments toward the ultimate purpose of providing a respirator 10 that resists collapse during use.

All of the embodiments of the respirators 10 require a support system with which they be held upon the face of the user. While various adhesives and other methods may be used to hold the respirator 10 on the face of the user, typically respirators 10 will held on with the use of one or more straps 20. Frequently, two thin elastic bands are integrally attached to the main body 12 of a respirator 10, especially a respirator 10 designed for industrial-type applications. These two straps 20 are intended to encircle the back and top of a wearer's head to help facilitate a close, tight fit. For example, the respirator illustrated in FIGS. 5 and 6 would engage such thin bands with the four fastening components, 22, 24, 26, 28 shown. Alternatively, wider straps 20 may be used for improved comfort and to prevent the straps 20 from rolling over on themselves, as may occur with thinner bands. Such wider straps may be used with the respirator 10 as shown in FIGS. 1 to 4 and engage the main body 12 with the pair of fastener components 22, 24.

The strap 20 may be made of woven, nonwoven, rubber, plastic, other materials, or combinations thereof. Similarly, the main body 12 of the respirator 10 may comprise many of these same materials. Generally the selected materials by which the main body 12 of the respirator 10 is constructed are cut, slit, or otherwise configured into forms adapted to cover portions of a user's face (e.g., the nose and mouth of a user). If individual layers or components need be attached to one another to make the main body of the respirator, then the layers or components may be attached to one another using, for example, heat, adhesives, ultrasonic energy, mechanical attachment devices (e.g., hook-and-loop fasteners), sewing, and the like. As noted elsewhere, the materials may be pre-cut in some way to facilitate attachment to a fastening component.

For elastomeric characteristics, the strap 20 may be made using suitable elastomeric fiber-forming resins or blends containing the same. The strap of the present invention may be a mixture of elastic and nonelastic fibers or particulates. The strap 20 may comprise elastomeric materials, such as a stretch-bonded laminate (SBL). In another version of the present invention, the strap 20 may comprise an elastomeric film, or individual elastic components, such as elastic strands (e.g., individual elastic strands may be extruded or formed such that they are spaced apart and substantially parallel, and to these strands may be attached meltblown or other fiber).

Any straps 20, as are known in the art, may be used to hold the respirator 10 confidently against the face of the user.

Different fastening systems may be used. In some of the depicted embodiments, the strap 20 comprises a flexible material adapted to encircle the head (e.g., a nonwoven material adapted to stretch). The strap 20 comprising this material is attached, at its ends, to a strap fastening component that can engage a corresponding fastening component 22, 24 on the main body 12 of the respirator 10. The fastening component 22, 24 may be attached to the strap in any number of ways know to those in the art (e.g., using adhesive; welding; by inputting thermal or other energy to fuse the materials; by using mechanical fastening elements to attach the strap to the strap fastening component—e.g., screws, rivets, snaps, hook-and-loop fasteners, etc.; or other such methods or combinations of methods, so long as the strap fastening component remains attached to the strap during use of the respirator with which the strap and strap fastening component are being employed).

Suitable materials for the fastening components 22, 24 may include plastics, metals, or combinations thereof. Preferred materials include thermoplastic polymers that can be molded into the desired shape by any of a variety of means known to those in the art, particularly injection molding. Such polymers include polypropylene, polyethylene, acrylonitrile butadiene styrene (ABS), polystyrene, nylon, polyvinyl chloride, and the like.

A strap 20 is engaged to the main body 12 of the respirator 10 through a fastening system formed by combining with the fastening component 22, 24 attached to the main body 12 (the fastening system is generally depicted in FIGS. 1, 4, 5, 6, 7 and 11 at 22, 24). While the fastening component 22, 24 shown in FIGS. 1, 4 and 11 has an angled or curved shaped, it should be recognized that the pull-strap fastening component can be any shape known in the art that is compatible with that described above.

In some embodiments, the fastening component 22, 24 on the main body 12 of the respirator 10 is also adapted to act as an exhalation vent 60 (i.e., vents to facilitate the channeling of exhaled air through the fastening component 22, 24 on the main body 12 of the respirator 10 and outward into the external environment). In FIGS. 1 and 2, the exhalation vents 61, 63 comprise channels through which air is conducted. In some embodiments, these vents facilitate movement of exhaled air away from the eyes of the wearer, thereby serving to reduce the amount of moisture-laden, exhaled air getting between the eyes of the wearer, and any eyeglasses worn by the wearer. Furthermore, such vents can provide for a greater volumetric flow rate of exhaled air to be conducted through the vents, rather than outward through the main body of the respirator. In some cases, the vents, ports, channels, or openings may be covered, e.g., with a porous or filter media, to reduce the amount of certain constituents in exhaled air escaping into the surrounding environment.

In some embodiments of the respirator 10, exhalation vent assemblies 61, 63 like that depicted in FIGS. 1 and 2 are employed with a respirator 10. FIGS. 9, 10 and 11 depict different components of various versions of an exhalation vent assembly. The inner vent body 80 in this representative version has an oval shape, but other shapes are possible (e.g., circular, etc.). The inner vent body 80 is attached to, or is placed adjacent to, the inner surface 13 of the main body 12 of the respirator 10. In one possible embodiment, the main body 12 of the respirator 10 would be pre-cut to have an opening through which a portion of the inner vent body 80 is inserted. For example, this opening may be placed at a location proximate to the perimeter of the main body 12 near the ear of a wearer of the respirator (e.g., similar in location to where the fastening components 22, 24 in FIG. 1 are located). While the strap 20 may be integrally attached to one side of the respirator 10, and releasably attached to the other side of the respirator 10, in some versions of the present invention an exhalation vent assembly like the representative version depicted in FIGS. 1 and 2 may be attached to both sides of the respirator 10 (the assembly includes a fastening component to which a strap fastening component may be releasably engaged). In versions such as this, the respirator 10 may have a pre-cut opening on both sides of the respirator's main body 12, thereby allowing an exhalation vent 60 to be attached to both sides of the main body 12 of the respirator 10.

For the inner vent body 80 depicted in FIG. 9, the inner vent body rim 82, which protrudes upward from the inner vent body 80, may be inserted through the pre-cut opening in the main body 12 of the respirator 10, with the edge portion 84 resting adjacent to at least some portion of the inner surface 13 of the main body 12 of the respirator 10. Attached to the rim 82 is a ledge 86, which generally serves to (1) help direct the flow of exhaled air (by blocking some portion of the opening 88 through which air proceeds), and/or (2) may serve, at least in part, as the point of attachment of a membrane (e.g., a film, substrate, or composite) that impedes or stops air from being drawn through the exhalation vent when a person is inhaling, but which allows air to be directed out through the exhalation vent when a person is exhaling. For example, a membrane that completely covers the opening 88, and which is attached only to the ledge 86, can operate as a movable flap that is pulled against the perimeter of the opening 88 when a person using the respirator inhales, thus stopping or impeding inward air flow (and thereby gaining the benefit of having inhaled air pass through the material used to make the main body of the respirator); but which, when a user of the respirator exhales, is pushed away from the perimeter of the opening to which the flap is not attached, thereby allowing air to pass out through the opening in the exhalation vent.

The inner vent body 80 will generally be shaped, and/or incorporate features, so that it can engage and/or mate with the outer vent body 93. So, in the representative version of an exhalation vent depicted in FIG. 10 the outer vent body 93 comprises an outer vent body rim 92 that fits around, and engages, the inner vent body rim 82. Furthermore, the rims 92, 82 can be designed to mechanically engage each other such that the inner- and outer vent bodies do not readily disengage from one another during use of the respirator. For example, the rims of the inner- and outer-vent bodies may comprise flange-like structures that snap into place when the outer vent body is placed over, and pushed down onto, the inner vent body (similar to, for example, a snap-on fastener). Many such mechanical connections are known and may be employed for this purpose. Other methods may be used to attach the inner- and outer vent bodies to one another, and to the main body of the respirator (e.g., using an adhesive, welding, thermal bonding, etc.).

The representative version of an outer vent body 93 depicted in FIG. 10 also comprises a divider 97 that basically splits the outer vent body opening 98 into two separate air channels. Depending on the orientation of the inner vent body 80, and whether the inner vent body ledge 86 at least partially covers the upper or lower air channel, a user or manufacturer can direct exhaled air (at least some portion thereof) in a desired direction.

Note that a divider need not be present. Or other configurations or geometries may be used so that a manufacturer or user can choose to attach the components of the exhalation vent assembly such that exhaled air, or some portion thereof, is channeled in a desired direction (e.g., away from eyes where, if a user of the respirator is also wearing glasses or other eye protection, warm, humid air may condense on eyeglass or eye-protection surfaces, thereby making it more difficult to see).

The three components are engaged to one another in the combined exhalation vent assembly 61, 63. It should be noted that the inner vent body ledge 86, which was oriented upward in the depiction in FIG. 9 of the separate component 80, is oriented downward in the combined assembly 110. It should also be noted that the membrane referred to above is not shown in FIG. 9 or 10. It should also be noted that the depiction in FIGS. 9 and 10 of the portions of the assembly does not show the main body 12 of the respirator 10, or portions thereof, which would of course be—at least in part—sandwiched between portions of the inner- and outer-vent bodies.

Typically the components depicted in FIGS. 9, 10, 11 and 12 are made of substantially rigid materials such as plastics, metal, and the like.

In addition to the elements discussed above, the respirators 10 may include addition features that enhance the use of such respirators 10. For example, the fit of such respirators 10 may be enhanced with the inclusion of a nose clip 151 that is deformable to the desired fit and seal about the nose applied by the user.

It should be noted that in some embodiments, a gasket material 161 is placed around at least a portion of the periphery 18 of the main body 12 of the respirator 10 that is adapted to face inward toward the skin of the wearer (e.g., comfort seals such as Hydra-gel, foams, or similar materials incorporated around the periphery of the respirator (at the respirator/wearer interface); or adhesive sealants to improve peripheral seal and respirator performance).

In some versions of the present invention, the periphery 18 of the main body 12 of the respirator 10 proximate to the eyes of a wearer is contoured to facilitate the wearer's choice to employ eyewear. Furthermore, one or more versions of the present invention may include components that facilitate attraction or attachment of a portion of any conventional or specially adapted eyewear to some portion of the respirator. Some portion of the periphery 18 of the respirator 10 proximate to the eyes of a wearer may comprise magnets, adhesive, or other mechanical fastening systems adapted to releasably engage at least a portion of the eyewear. For example, a ferrous or other magnetic inner wire may be employed proximate to the upper perimeter of the respirator. This wire can interact with any magnet employed in eyewear. Furthermore, the wire can be flexed or adjusted to customize the fit of the respirator and/or eyewear, helping prevent the safety glasses from sliding off the face or moving around the contour of the respirator.

As noted elsewhere, the respirator may be disposable. For example, the entire respirator (e.g., in one representative version, comprising a main body; a strap comprising strap fastening components; and fastening components attached to the main body, and adapted to releasably engage the strap fastening components) may be disposable (e.g., after a single use, or limited use).

The manufacturer or distributor of a respirator of the present invention may fashion messages, statements, or copy to be transmitted to a purchaser, consumer, or user of said respirator. Such messages, statements, or copy may be fashioned to help facilitate or establish an association in the mind of a user of the respirator between a respirator of the present invention, or use thereof, and one or more mental states, psychological states, or states of well being. The communication, statements, or copy may include various alphanumeric strings, including, for example: disposable, convenience, ease, ease of use, comfort, safety, motocross, X-sports, maintenance, repair, cyclocross, skateboarding, snowboarding, healthcare, operating, surgical, and derivatives or combinations thereof, or other such words or states. In one embodiment, the communication, statements, or copy associate a respirator of the present invention and ease of donning. In another embodiment, the communication, statements, or copy associate a respirator of the present invention and disposability. In another embodiment, the communication, statements, or copy associate a respirator of the present invention and a registered or common-law trademark of the seller, manufacturer, and/or distributor of the appliance. For example, a statement could be disposed in or on a container containing a respirator of the present invention that associates the respirator with a logo or brand name or manufacturer such as Kimberly-Clark, Kimberly-Clark Professional, Kleenguard®, 3M, Moldex, Gerson, some other logo or brand name or manufacturer or seller of respirators, or combinations thereof.

Messages, copy, statements, and/or alphanumeric strings like those referred to above may be used either alone, adjacent to, or in combination with, other alphanumeric strings. The communication, statements, message, or copy could take the form of (i.e., be embodied in a tangible medium such as) a newspaper advertisement, a television advertisement, a radio or other audio advertisement, items mailed directly to addressees, items emailed to addresses, Internet Web pages or other such postings, free standing inserts, coupons, various promotions (e.g., trade promotions), co-promotions with other companies, copy and the like, boxes and packages containing the product (in this case a respirator of the present invention), and other such forms of disseminating information to consumers or potential consumers. For example, a message embodied in a tangible medium could associate a respirator of the present invention with a logo or brand name or manufacturer such as Kimberly-Clark, Kimberly-Clark Professional, Kleenguard®, 3M, Moldex, Gerson, some other logo or brand name or manufacturer or seller of respirators, or combinations thereof.

It should be noted that when associating statements, copy, messages, or other communications with a package (e.g., by printing text, images, symbols, graphics, color(s), or the like on the package; or by placing printed instructions in the package; or by associating or attaching such instructions, a coupon, or other materials to the package; or the like) containing one or more respirators of the present invention, the materials of construction of said package may be selected to reduce, impede, or eliminate the passage of water or water vapor through at least a portion of the package. Furthermore, the materials of construction of said package may be selected to minimize or impede the passage of light through said package, including minimizing or impeding the passage of electromagnetic waves of a selected wavelength or wavelengths.

Furthermore, respirators may be individually wrapped in containers, packets, envelopes, bags, wrappers, or the like that inhibit, reduce, or eliminate the passage or transmission of water or water vapor. For purposes of this application, "packages," "containers," "envelopes," "bags," "packets," and the like are interchangeable in the sense that they refer to any material adapted to enclose and hold either individual respirators (as in, for example, an individual package containing a single respirator), or a plurality of respirators (as in a flexible bag made of film or plastic container containing a plurality of respirators, whether or not each of the individual respirators are enclosed and held in a separate material—such as individual packages).

In some embodiments of the present invention, a package will contain not only one or more respirators of the present invention, but other health-and-hygiene products. In one embodiment, a respirator of the present invention is sold, transferred, distributed, or marketed with eyewear, especially eyewear adapted to attach, adhere, or be attracted to (e.g., via magnetic interactions) at least a portion of the respirator. It should be noted that such combinations may be marketed and packaged as described in the preceding paragraphs. It should also be noted that statements on packages, messages embodied in tangible media, and packages like those described in this paragraph may be associated with the brand name or logo of a private-label brand (meaning that a product or article of manufacture, like a respirator of the present invention, is made by one company for sale under the logo or brand name of another company—often the logo or brand name of a retailer or distributor).

Having described the invention in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above respirators without departing from the scope of the present disclosure, it is intended that all matter contained in the above description and shown in the accompanying drawings shall be interpreted as illustrative and not in a limiting sense.

What is claimed is:

1. A respirator comprising:

a main body adapted to cover the mouth and nose of a user of the respirator, the main body having an inner surface adjacent the user and an opposite outer surface;

fastening components attached at opposite sides of the main body, each of the fastening components further comprising:

a base portion attached to the main body;

an extension portion that extends rearwardly from the main body opposite from the base portion;

a fastening strap connected to the extension portions;

the extension portion including an angled arm that extends outwardly and rearwardly from said base portion;

a heel defined between the base portion and the angled arm, the heel defining a pivot point between the base portion and the extension portion; and wherein the extension portions are disposed in a plane that is outwardly offset from the base portion such that a tightening force applied to the straps pulls the extension portions towards the user's head and pivots the base portion and attached main body away from the user's face.

2. The respirator as in claim 1, wherein the extension portion extends in a plane that is essentially parallel to the base portion.

3. The respirator as in claim 1, further comprising a strut that extends along a central portion of the main body between the fastening components, the strut shaped so as to provide an outwardly bowed bias to the main body away from the user's mouth and nose.

4. The respirator as in claim 3, wherein the strut extends along the inner surface of the main body.

5. The respirator as in claim 3, wherein the strut has opposite ends and is continuous between the opposite ends.

6. The respirator as in claim 5, wherein the opposite ends of the strut are attached to the base portions of the fastening component.

7. The respirator as in claim 6, wherein the strut is unattached to the main body between the fastening components.

8. The respirator as in claim 3, wherein the strut is discontinuous between the fastening components.

9. The respirator as in claim 1, further comprising a stiffening material applied to the inner surface of the main body between the fastening components.

10. The respirator as in claim 9, wherein the stiffening material is applied as separate lines between the fastening components.

11. The respirator as in claim 10, wherein the separate lines define a crossing pattern.

12. The respirator as in claim 9, wherein the stiffening material is applied as an overlapping wave pattern between the first and second vent bodies.

* * * * *